US007292204B1

(12) United States Patent
Chang et al.

(10) Patent No.: US 7,292,204 B1
(45) Date of Patent: Nov. 6, 2007

(54) DIELECTRIC RESONATOR ANTENNA WITH A CAVED WELL

(75) Inventors: Tze-Hsuan Chang, Taipei (TW); Jean-Fu Kiang, Taipei (TW)

(73) Assignee: National Taiwan University, Taipei (TW)

( * ) Notice: Subject to any disclaimer, the term of this patent is extended or adjusted under 35 U.S.C. 154(b) by 0 days.

(21) Appl. No.: 11/551,711

(22) Filed: Oct. 21, 2006

(51) Int. Cl.
*H01Q 15/02* (2006.01)

(52) U.S. Cl. ..... 343/909; 343/911 R; 343/846

(58) Field of Classification Search ..... 343/909 R
See application file for complete search history.

(56) References Cited

U.S. PATENT DOCUMENTS 5,952,972 A * 9/1999 Ittipiboon et al. ... 343/700 MS
6,572,955 B2 * 6/2003 Terashi et al. ..... 428/209
7,154,441 B2 * 12/2006 Hansen et al. ..... 343/700 MS
2003/0234695 A1 * 12/2003 Harua et al. ..... 331/68
2004/0051602 A1 * 3/2004 Pance et al. ..... 333/202
2004/0164367 A1 * 8/2004 Park ..... 257/415
2004/0169604 A1 * 9/2004 Lee et al. ..... 343/700 MS
2005/0088340 A1 * 4/2005 Deng et al. ..... 343/700 MS
2005/0179598 A1 * 8/2005 Legay et al. ..... 343/700 MS

* cited by examiner

*Primary Examiner*—Trinh Vo Dinh

(57) ABSTRACT

A dielectric resonator antenna is a dielectric resonator mounted on a feed-in/feed-out component. The dielectric resonator is a rectangular parallelepiped made of a dielectric, and has a caved well passing through from the top surface to the bottom surface thereof. The feed-in/feed-out component includes a dielectric substrate, a ground metal layer and a strip metal layer coated on the top surface and the bottom surface, respectively, of the dielectric substrate. An etched part is provided on the ground metal layer. Wherein, the dielectric resonator with the caved well is mounted on the ground metal layer of the feed-in/feed-out component.

4 Claims, 6 Drawing Sheets

DIELECTRIC RESONATOR ANTENNA WITH A CAVED WELL

BACKGROUND OF THE INVENTION

1. Field of the Invention

The present invention relates to a dielectric resonator antenna, and in particular to a rectangular dielectric resonator, of which part of the dielectric is removed to form a rectangular caved well, for enhancing electric field and expanding bandwidth.

2. The Prior Arts

A conventional dielectric resonator antenna is usually made of a material with high dielectric constant and low loss. The dielectric resonator antenna has many advantages, for example, high radiation efficiency, simple structure, and various radiation patterns achieved by stimulating various modes. However, it is a resonator antenna, and its bandwidth is limited. Basically, the dimensions and shape of the antenna decide the operating frequency and the bandwidth of the resonator antenna.

The means to increase the bandwidth of the dielectric resonator antenna include: (1) cutting off the apex of a conical dielectric resonator, making the smaller cross-section grounded, and using a probe to feed in, thereby achieving about 40% of bandwidth; (2) increasing the ratios of length to height or width to height of a rectangular parallelepiped dielectric resonator, which may also increase the bandwidth; (3) piling a plurality of dielectric resonators with various sizes and resonant frequencies close to each other, thereby combining the operating bandwidth to increase the bandwidth; (4) mounting a dielectric resonator above a patch antenna, and providing a slot on the patch antenna, thereby feeding energy into the dielectric resonator and combining the operating bandwidths of these two antennas to increase the bandwidth; (5) coating a metal layer on a dielectric resonator to incur extra resonance, and making the resonant frequency close to the frequency of the dielectric resonator, thereby extending the bandwidth of the original dielectric resonator antenna. All these methods increase the complexity of the manufacturing process and the cost. Therefore, the present invention carries on the improvement on the bandwidth limitation of the dielectric resonator antenna.

SUMMARY OF THE INVENTION

The present invention is a dielectric resonator antenna, which actually resolve the bandwidth limitation of the dielectric resonator antenna in the related arts mentioned above.

A primary objective of the present invention is to provide a caved well in a dielectric resonator antenna, which makes energy radiate more efficiently and reduce the quality factor of the antenna to increase the bandwidth.

Another objective of the present invention is to provide geometric parameters of the dielectric resonator antenna and the caved well, which combines the frequency bands of the dielectric resonator antenna in mode $TE_{111}^{X}$ and $TE_{111}^{X}$ to increase the bandwidth.

A further objective of the present invention is to provide a feed-in/feed-out component, which in conjunction with the dielectric resonator antenna to effectively feed in or feed out the electromagnetic signals.

A still further objective of the present invention is to take advantage of the simple geometric structure of the dielectric resonator antenna to keep the advantages of the low cost and the simple manufacturing process.

Based on the objectives mentioned above, the present invention provides a dielectric resonator antenna, which comprises a dielectric resonator. The dielectric resonator is a rectangular parallelepiped resonator made of a dielectric, and a cuboid is cut out from the resonator to form a caved well, thereby forming a dielectric resonator antenna, which can receive or transmit the signals of specific bandwidth. The dielectric resonator is mounted on a surface of a dielectric substrate. The top surface of the dielectric substrate is coated with a ground metal layer and the bottom surface of the dielectric substrate is coated with a strip metal layer. The dielectric substrate is made of a dielectric material, and the ground metal layer and the strip metal layer are conductive circuits. Part of the ground metal layer is etched off to form a slot, that is, an etched part. The strip metal layer and the etched part form a feed-in/feed-out component for the dielectric resonator. The feed-in/feed-out component feeds signals of specific bandwidth to the dielectric resonator for transmitting, or picks up signals received by the dielectric resonator. The geometric dimensions of the dielectric resonator antenna are related to the received signals or transmitted signals of specific frequency and bandwidth.

Therefore, according to the present invention, the rectangular parallelepiped resonator is made of a dielectric material and provided with a rectangular caved well, which may achieve 34% bandwidth. Also the dielectric resonator antenna has advantages of small size, simple structure and easy to manufacture. In the meantime, using a microstrip as the signal line and using coupled slot to feed in the antenna make the dielectric resonator antenna easy to integrate with other planar circuit, and reduce interference between the antenna and the other components.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
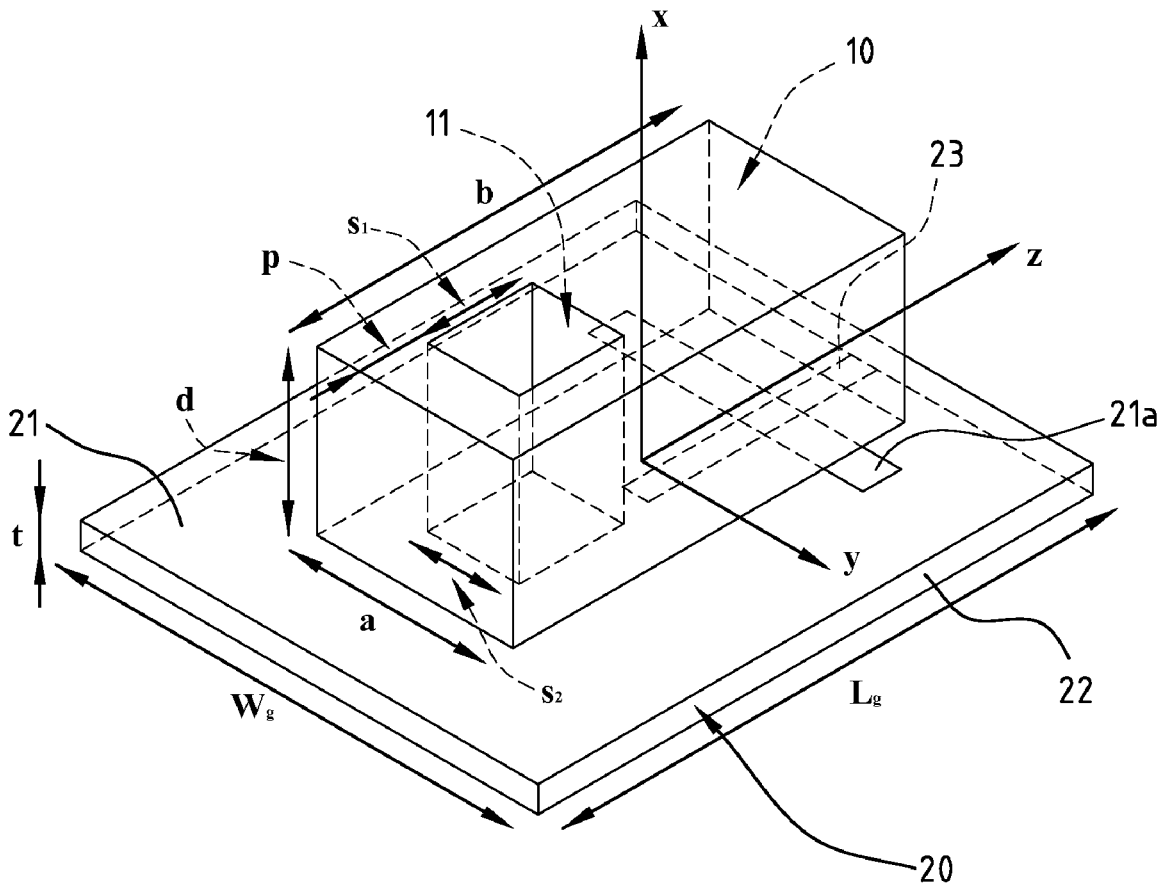
FIG. 1 is a perspective view showing a dielectric resonator antenna in accordance with a preferred embodiment of the present invention.
Figure 2:
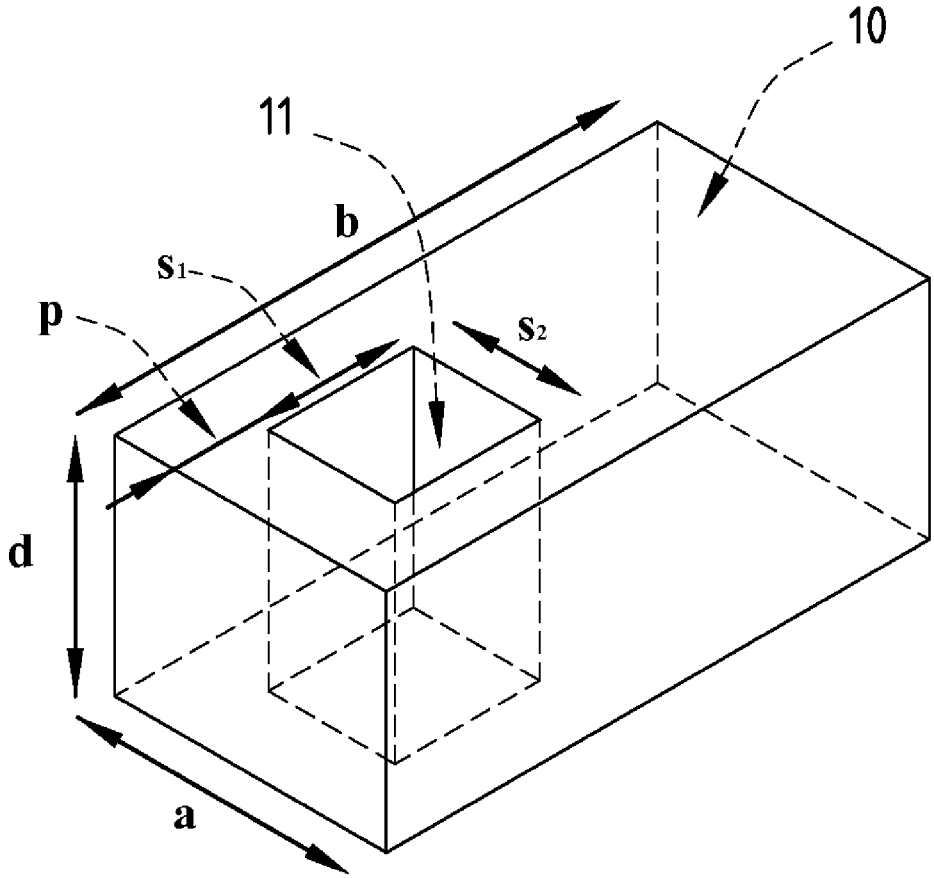
FIG. 2 is a perspective view showing a dielectric resonator of the dielectric resonator antenna in accordance with the preferred embodiment of the present invention.
Figure 3:
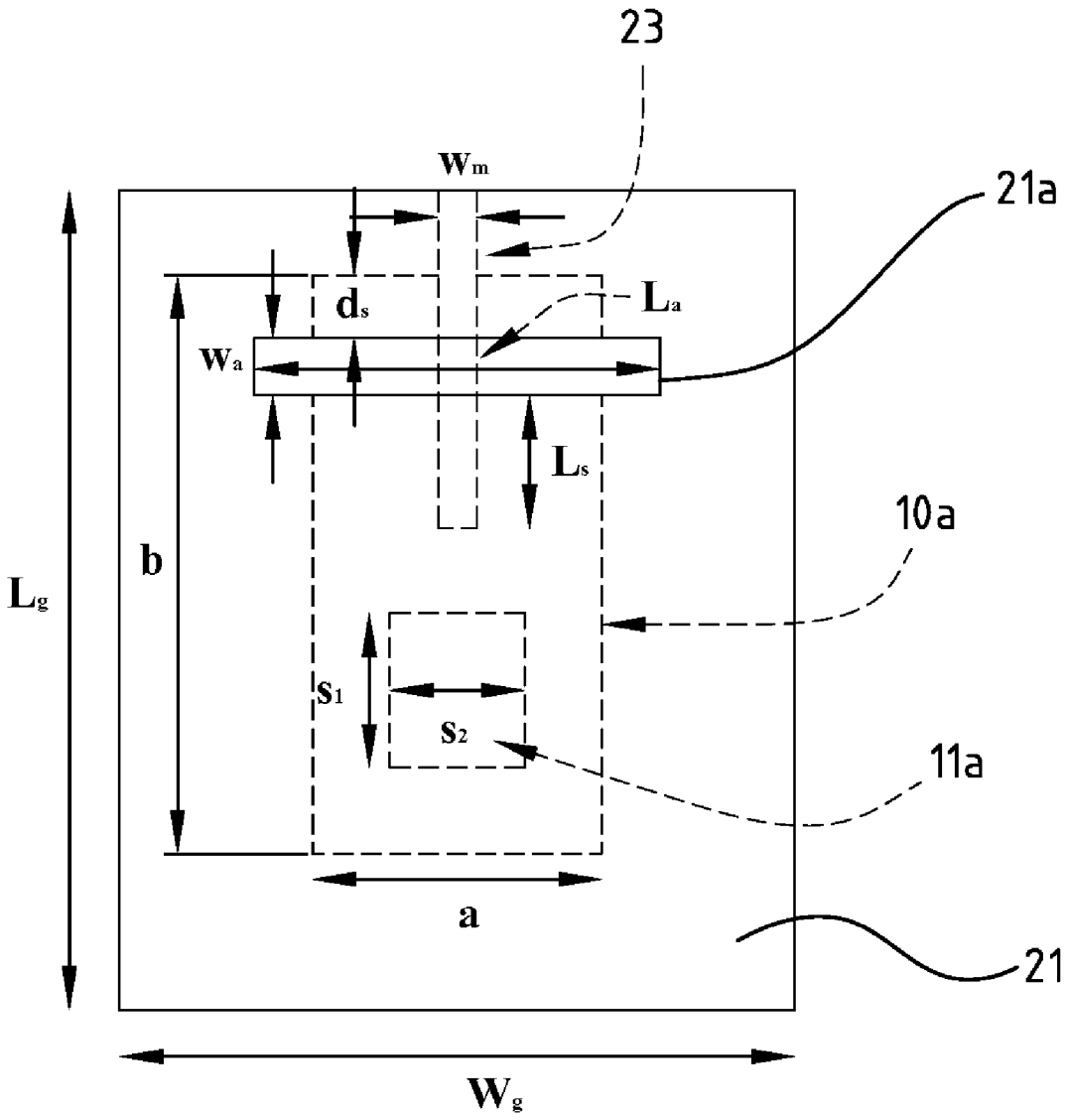
FIG. 3 is a schematic view showing a circuit diagram of a feed-in/feed-out component of the dielectric resonator antenna.

With reference to the drawings and in particular to FIGS. 1, 2 and 3, a dielectric resonator antenna in accordance with the present invention comprises a dielectric resonator 10 receiving or transmitting signals of specific bandwidth and a feed-in/feed-out component 20. Wherein, the dielectric resonator 10 is a rectangular parallelepiped made of a dielectric, and a rectangular cavity passing through from the top surface to the bottom surface of the dielectric resonator 10 to form a caved well 11. The dielectric resonator 10 is made of dielectric materials including low-temperature co-fired ceramics and materials with high dielectric constants. The feed-in/feed-out component 20 is a dielectric substrate 22 whose top surface and bottom surface are coated with a ground metal layer 21 and a strip metal layer 23, respectively.

The dielectric substrate 22 of the feed-in/feed-out component 20 is made of dielectric materials such as FR4, Teflon, Duriod, fiberglass, aluminum oxide, ceramic materials and other dielectric materials. The ground metal layer 21 is an electric circuit, which is a conductive material printed on the top surface of the dielectric substrate 22. The ground metal layer 21 also has an etched part 21*a*, which is a slot etched from the ground metal layer 21. The strip metal layer 23 is an electric circuit, which is a conductive material printed on the bottom surface of the dielectric substrate 22.

Referring to FIG. 3, the dielectric resonator 10 is mounted on the upper surface of the ground metal layer 21 of the feed-in/feed-out component 20. Wherein, a part of the ground metal layer 21 underneath the dielectric resonator 10 is defined as a resonator foot-print region 10*a*, and a part of the resonator foot-print region 10*a* beneath the caved well 11, is defined as a caved well foot-print region 11*a*. Therefore, the etched part 21*a* is across the resonator foot-print region 10*a* and parallel to the caved well foot-print region 11*a*. As shown in FIG. 3, the location of the caved well foot-print region 11*a* is near the center of the dielectric resonator 10 in the direction parallel to the longitudinal direction of the etched part 21*a* and the etched part 21*a* is not overlapped with the caved well foot-print region 11*a*.

Furthermore, a part of the bottom surface underneath the etched part 21*a* is defined as an etched part projection region. The strip metal layer 23 extends from one edge of the dielectric substrate 22 toward the caved well foot-print region 11*a*, and passes through the etched part projection region. Wherein, the length, the width, the height of the dielectric resonator 10 are a, b and d, respectively; the length and the width of the feed-in/feed-out component 20 (or the ground metal layer 21) are Lg and Wg, respectively; the width of the strip metal layer 23 is Wm; the length of a part of the strip metal layer 23 extending over the etched part 21*a* is Ls; the length and the width of the etched part 21*a* are La and Wa, respectively; and the length and the width of the caved well 11 are s1 and s2, respectively. The strip metal layer 23 and the etched part 21*a* incur a coupling effect of the electromagnetic signals.

The antenna according to the present invention comprises the dielectric resonator 10 and the feed-in/feed-out component 20. The dimensional parameters of the dielectric resonator antenna are a=6.64 mm, b=15.7 mm, d=7.9 mm, s1=6.15 mm, s2=4.05 mm, the distance between the edge of the dielectric resonator 10 and the edge of the caved well 11 is p=1.7 mm. The length and the width of the etched part 21*a* are Wa=2 mm and La=13 mm, respectively. The length and the width of the ground metal layer 21 are Wg=Lg=60 mm. The thickness of the feed-in/feed-out component 20 is t=0.6 mm. The dielectric constant of the dielectric substrate 22 is 4.4, and the dielectric constant of the dielectric resonator is 20. Furthermore, the distance between the edge of the dielectric resonator 10 and the edge of the etched part 21*a* is ds=2.8 mm. The length of the part of the strip metal layer 23 extending over the etched part 21*a* is Ls=6 mm.

Figure 4:
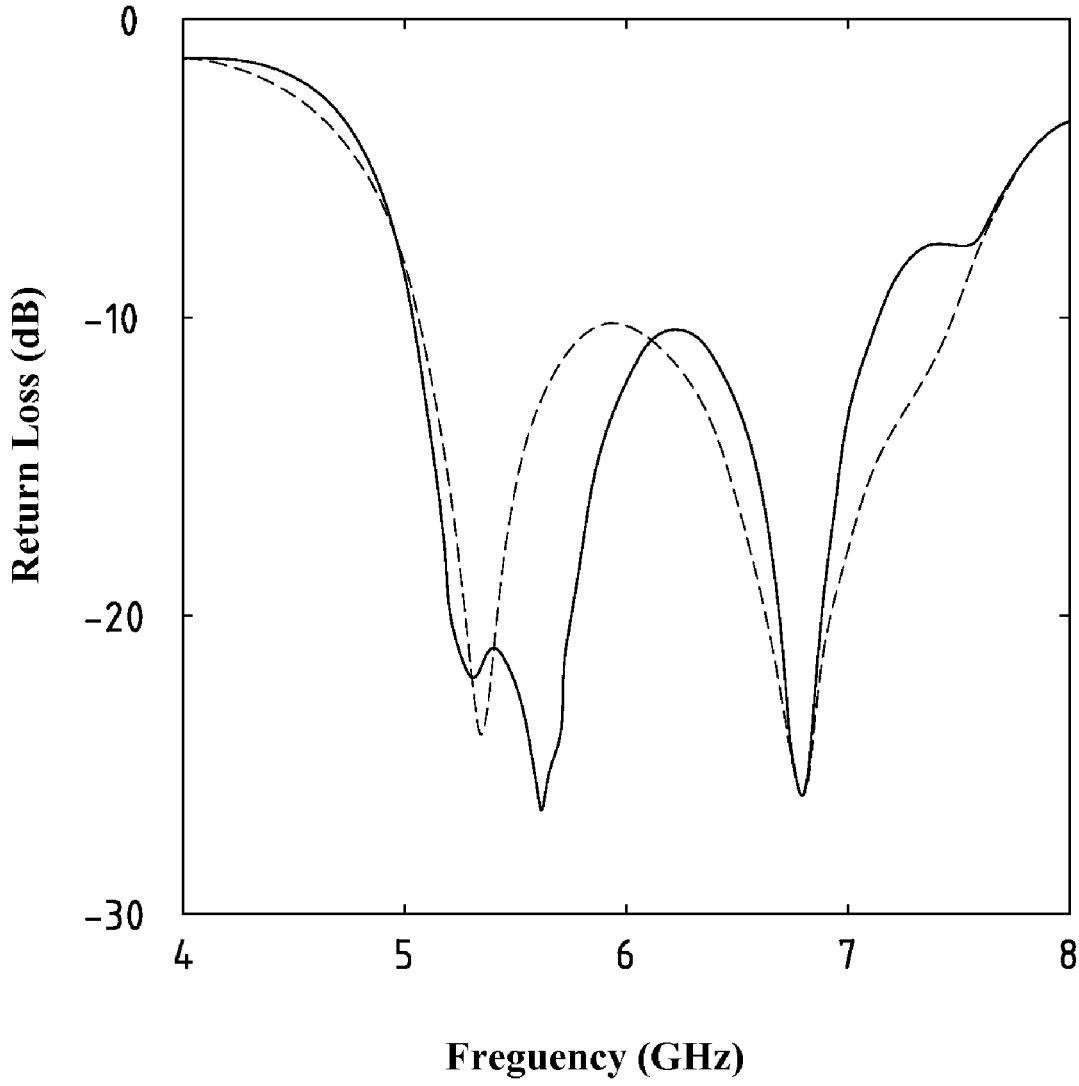
FIG. 4 is a graph showing the relation between frequency and return loss of the antenna in accordance with the present invention.
Figure 5:
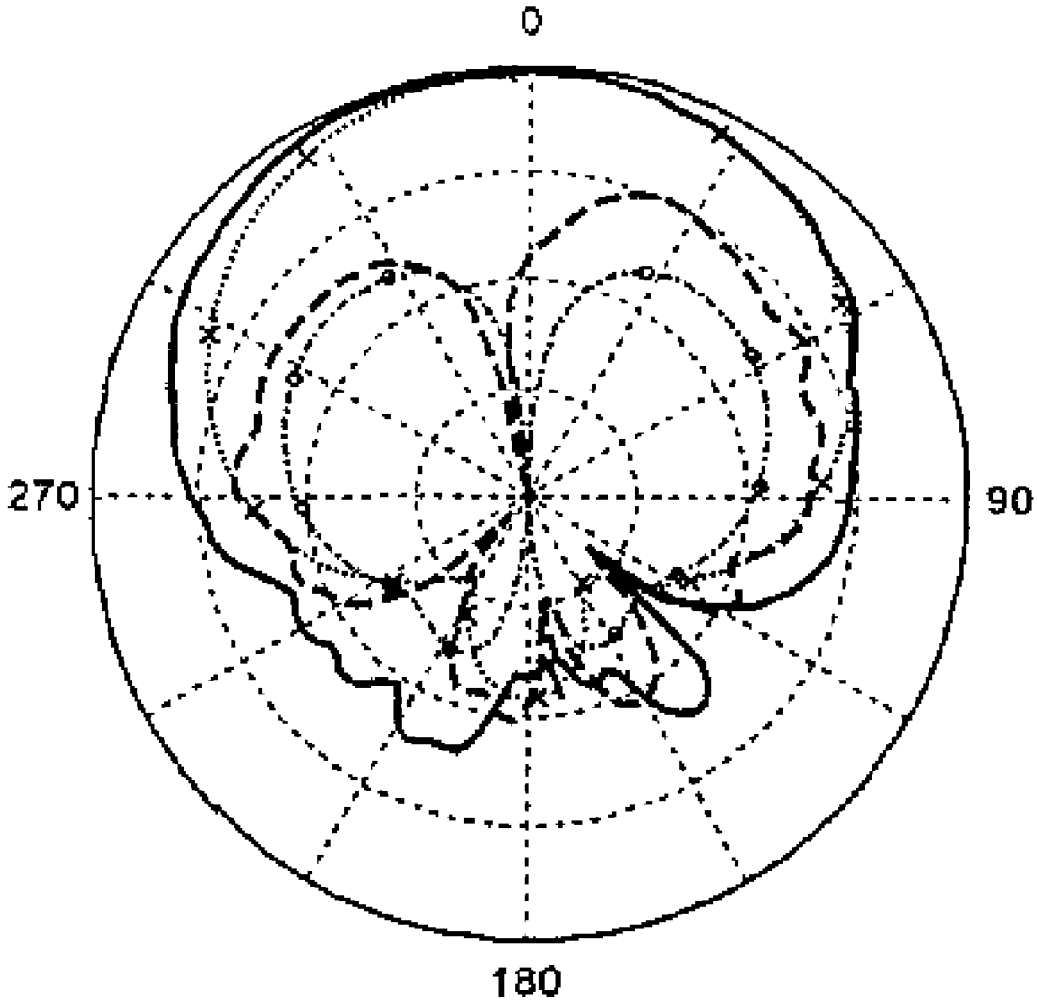
FIG. 5 is a radiation pattern of the antenna in accordance with the present invention in the XY-plane at a frequency of 5.35 GHz.
Figure 6:
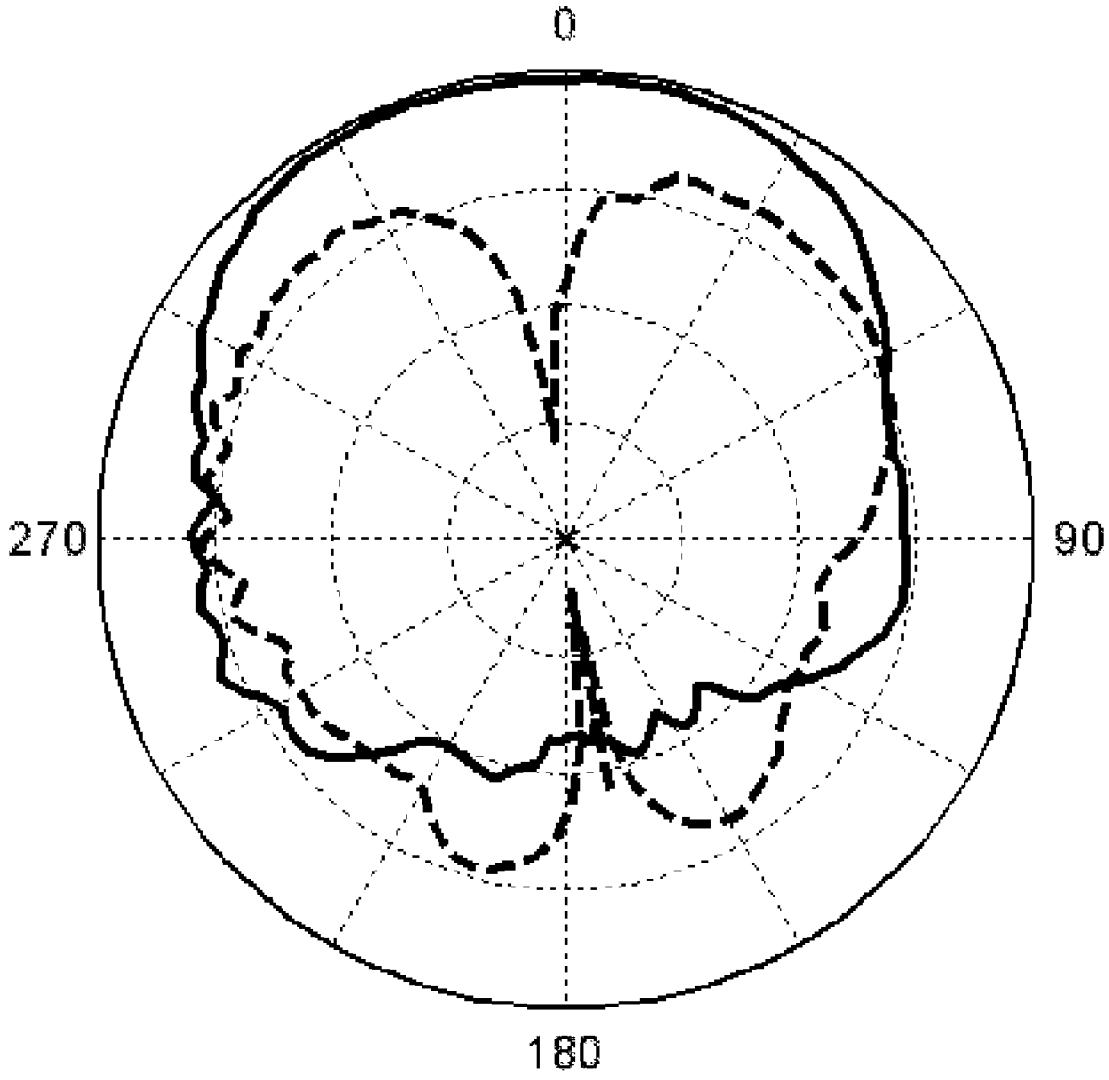
FIG. 6 is a radiation pattern of the antenna in accordance with the present invention at a frequency of 6.73 GHz and on a $\theta=45°$ tapered-shape cross section.

FIG. 4 shows the relation between frequency and return loss of the dielectric resonator antenna in accordance with the above-mentioned embodiment of the present invention, wherein the solid line shows the data measured from experiments, and the dash line shows the data simulated by a software package. FIG. 5 is the radiation pattern of the antenna in the XY-plane at the frequency 5.35 GHz, wherein the solid line is $E_\theta$, and the dash line is $E_\Phi$. FIG. 6 shows the radiation pattern on the tapered-shape cross section of θ=45 at the frequency 6.73 GHz, wherein the solid line is $E_\theta$, and the dash line is $E_\Phi$.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A dielectric resonator antenna, comprising:

a dielectric resonator, which is a rectangular parallelepiped made of a dielectric material, having a rectangular caved well passing though from a top surface to a bottom surface thereof; and a feed-in/feed-out component, comprising:

a dielectric substrate, which is a substrate made of a dielectric material;

a ground metal layer, which is a conductive material provided on a top surface of the dielectric substrate and having an etched part etched therefrom; and a strip metal layer, which is a conductive material provided on a bottom surface of the dielectric substrate;

wherein the dielectric resonator with the caved well is mounted on the ground metal layer of the feed-in/feed-out component, wherein the caved well is positioned on the ground metal layer in an area which is not overlapped with the area of the etched part.

2. The antenna as claimed in claim 1, wherein the dielectric resonator is mounted on the top surface of the ground metal layer of the feed-in/feed-out component, wherein a part of the ground metal layer beneath the dielectric resonator is defined as a resonator foot-print region, wherein a part of the resonator foot-print region beneath the caved well is defined as a caved well foot-print region, wherein a part of the bottom surface of the dielectric substrate beneath the etched part is defined as an etched part projection region, wherein the etched part extends across the resonator foot-print region and is parallel to the caved well foot-print region, and wherein the strip metal layer extends from one edge of the dielectric substrate toward the cave well foot-print region and passes through the etched part projection region.

3. The antenna as claimed in claim 1, wherein the dielectric resonator is made of one of dielectric materials including low-temperature co-fired ceramics and materials with high dielectric constants.

4. The antenna as claimed in claim 1, wherein the dielectric substrate is made of one of dielectric materials including FR4, Teflon, Duriod, fiberglass, aluminum oxide, and ceramic materials.

* * * * *